United States Patent [19]

Lipp

[11] 4,413,790

[45] Nov. 8, 1983

[54] MIXER FOR BULK MATERIALS, ESPECIALLY FOR FIBROUS SUSPENSIONS

[75] Inventor: Eberhard Lipp, Straubenhardt, Fed. Rep. of Germany

[73] Assignee: Draiswerke GmbH, Mannheim, Fed. Rep. of Germany

[21] Appl. No.: 307,424

[22] Filed: Oct. 1, 1981

[30] Foreign Application Priority Data

Oct. 2, 1980 [DE] Fed. Rep. of Germany ..... 3037332

[51] Int. Cl.[3] ..... B02C 15/00

[52] U.S. Cl. ..... 241/101 B; 241/199.12

[58] Field of Search ..... 366/325, 327, 329, 279; 241/199.9, 101.2, 199.12, 221, 241, 242, 243, 239, 172, 101 B

[56] References Cited

U.S. PATENT DOCUMENTS

| | | | |
|---|---|---|---|
| 221,371 | 11/1879 | Stevens | 241/241 X |
| 1,302,398 | 4/1919 | Mangini | 241/241 X |
| 2,492,421 | 12/1949 | Golben | 241/101 B |
| 3,993,254 | 11/1976 | Bicik et al. | 241/172 X |
| 4,236,677 | 12/1980 | Lodige et al. | 241/172 |

FOREIGN PATENT DOCUMENTS 1020002 5/1958 Fed. Rep. of Germany .

OTHER PUBLICATIONS

Journal "Chemiker-Zeitung", 94 vol., (1970), No. 4, p. 123.

*Primary Examiner*—Mark Rosenbaum

*Attorney, Agent, or Firm*—Balogh, Osann, Kramer, Dvorak, Genova & Traub

[57] ABSTRACT

This concerns a mixer for bulk materials, especially for fibrous suspensions such as cellulose derivatives and substances of similar description, in which a driveable scooper is arranged in a horizontally aligned drum- or trough-shaped container. The scooper consists of a shaft set to run along the container, from which mixing blades protrude. The shaft bears milling rims arranged sloping relative to the shaft. The milling rims are connected immovably to the shaft.

The milling rims lie opposite to the milling stators and form milling spaces with these milling stators, which are fitted to the container stationarily.

12 Claims, 3 Drawing Figures

MIXER FOR BULK MATERIALS, ESPECIALLY FOR FIBROUS SUSPENSIONS

Figure 1:
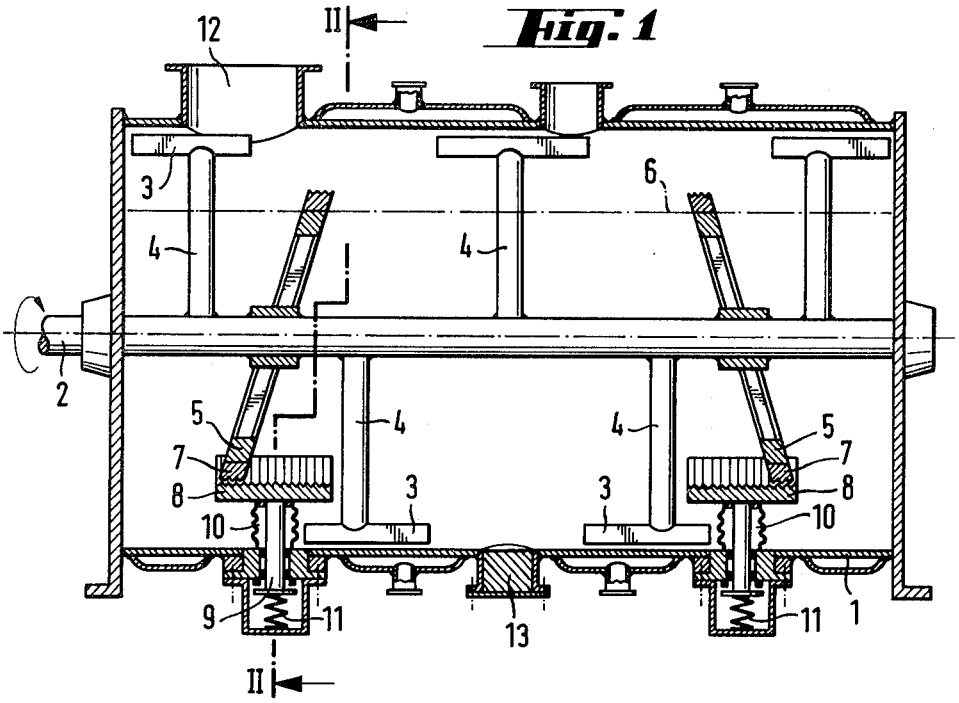

The invention concerns a mixer for bulk materials, especially for fibrous suspensions such as cellulose derivatives, in the form of a horizontally-aligned drum- or trough-shaped container with driveable mixing blades, and which has a radially-aligned moving axle running along the longitudinal direction of the container.

There are such devices known for drying, reacting and mixing of bulk materials which have a drum-shaped container with a horizontal longitudinal axle, and in which a driveable shaft is centrally located. This shaft carries the mixing tool on radially-aligned arms. Such devices are not adequate for pulverizing hard, tough or fibrous agglomerates or granulates which are present in the end product or which arise during drying, reacting, or mixing. Such agglomerates lead to increased drying times, reaction times, and inhomogenous end products. Besides, it is usually necessary to shift the gears to a milling process in order to crush the agglomerates.

On these grounds various supplemental devices have been developed for such equipment, such as built-in pinned disk mills or cutter-heads, which tear to pieces such agglomerates as arise, mainly through impacting processes. The following are some of the disadvantages:

Costly sealing of the revolving shaft of the device;

The danger of the breaking off of the moving shafts of the supplemental devices;

In the continuing drying stage, if the agglomerates have dried on the outer surfaces but the core remains plastic, the impact process leads to condensation, through which resistance to diffusion is increased and the product, in some cases, damaged;

The end product has a very heterogenous grain distribution;

Additional drive units are needed in addition to the main shaft drive;

A milling process has to be shifted to.

The objective of the invention is to develop a sturdy mixing apparatus for the warm treatment of bulk materials, and one which avoids the forementioned disadvantages and, above all, instead of crushing by an impact process, the apparatus enables crushing by rubbing and cutting.

The milling rims, in connection with the milling stators, make possible the adjustment of milling split and thereby a forceful crushing, so that a homogenous grain distribution is produced by means of the milling spaces, and thus the process of shifting to a milling process can be eliminated.

The milling rims can be arranged on spoked wheels. If the milling rims are arranged on unperforated disks, then this benefits the mixing process, because the disks channel the bulk materials to move in an axial direction. A further advantage is that the disks can also be heated, so that the drying time is shortened.

The milling stators consist preferably of cylinder surfaces or ledges arranged on the surfaces of an imaginary cylinder, which are adjustable with the container housing. In this way, perforated milling stators have the advantage that they are permeable to the bulk materials so as to facilitate the mixing process. The milling rims consist of interchangeable milling segments arranged on the circumference. Since the holders of the milling stators can move only in their axial direction, that is, in a radial direction in relation to the shaft of the mixer, they can easily and sturdily be executed or mounted, and so a lateral breaking-off is eliminated.

The suitable number of pairs of the milling tools formed from such milling rims and milling stators is determined by the length of the mixer, by the retention time, and by the characteristics of the bulk materials. As specified by the invention, at least one such pair is to be provided, though preferably more, but in any event there should not be more than one such pair between each two neighboring mixing-blades.

With the apparatus as made according to the invention, one can continuously or non-continuously dry or react, but also heat, cool, or mix moist, fibrous, or pulpy bulk materials and suspensions at negative, normal or positive pressure.

The material to be handled can be continously homogenized, loosened and conveyed through the milling tools, which shred the material in milling spaces formed by them (i.e., by the milling tools). The milling rims are preferably slanted on both sides, and the sloping surfaces are directed towards the milling stator, so that they impart to the bulk material a movement in the direction of the milling stator. There are arrangements provided to carry off the moisture derived from the material, and which can supply reactants.

Figure 2:
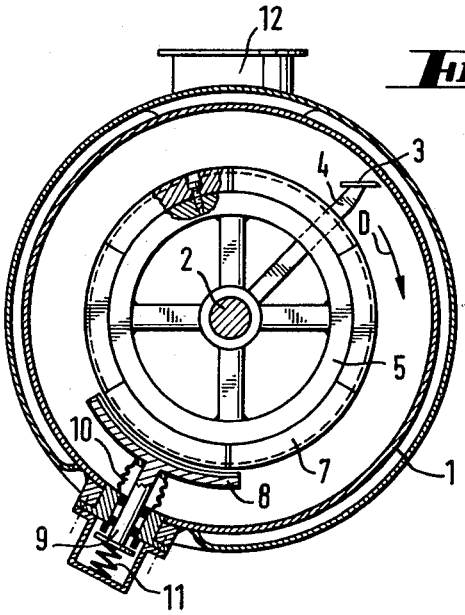
Figure 3:
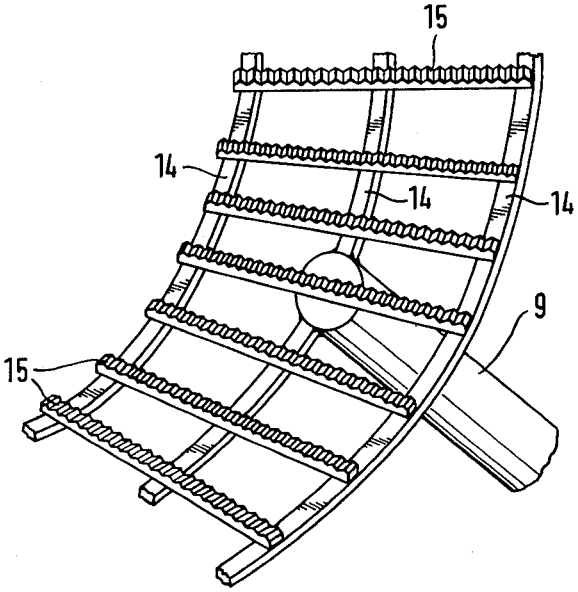

Additional details are shown in the diagram as favorable developments of a mixing-drying apparatus according to the invention, with the following description:

FIG. 1, the longitudinal section of an apparatus as specified by the invention;

FIG. 2, the cross-section II—II of the apparatus relative to FIG. 1;

FIG. 3, a detail of the declined milling stator in perspective drawing.

As is evident from the drawings, the diagrammed mixer for the bulk materials, especially for fibrous suspensions, consists of a drum-shaped container (1) with a mixing blade (3) above a shaft (2) which runs through the container (1), with supporting brackets (4) which are symmetrically placed over the shaft (2) at a distance and by an angular arrangement. Between some of these mixing blades (3) are attached additional milling rims (5) central to the rotating shaft (2), slanting relative to their longitudinal axes, which carry out a tumbling motion by rotating. The optimal fill level of the container (1) with bulk material (6) is approximately 70%.

The milling runs (5) in their circumference peripheral or outer surfaces work together with the stationary opposite surfaces of a milling stator (8), so that preferably both sides are profiled for the formation of cutting and scraping edges. The opposite surfaces consist of cylinder part surfaces which are arranged so that they are adjustable to the container housing (1), while the circumference peripheral or outer surfaces of the milling rims (5) are formed from interchangeable milling segments (7). The opposite surfaces of the milling stators (8), which are adjustable from the outside, and radially directed along the shaft (2), are in such a way arranged upon supports (9), that at one or both sides, mixing blades (3) can be conducted underneath, as can be seen in FIG. 1. The adjustable supports (9) for the opposite surfaces can be sealed by means of an expansion joint (10). The opposite surfaces of the milling stator (8) (as seen in the rotation direction, D, of the shaft (2)), are arranged in the lower portion of the container housing (1), though preferably on the ascending part of the moving mixing blades (or of the container housing), and make up about 10–50%, preferably 25%, of the circumference of the housing (1).

The effective breadth or width of the milling rims (5) corresponds approximately to the width dimension of the mixing blades (3). The opposite surfaces of the milling stators (8) lie, as is evident from FIGS. 1 and 2, under the action of springs (11). Here the adjustable supports (9) of the milling stators (8) can be utilized as spring blocks, by which the spring blocks can be shaped by the so-called fixed spring blocks, which are not specially diagrammed here, so that a constant pressure can be maintained. The nozzles (12, 13) in the housing (1) serve for filling and emptying.

The large-surfaced milling stators which are not permeable to bulk material (as per FIGS. 1 and 2) can be replaced by milling stators as specified in FIG. 3, which are permeable to the bulk materials. These consist of an assembly which has arc-shaped ribs (14) which connect with the cutting edges (15). The cutting edges (15) are equipped on the side turned towards or facing the milling rim with a profiled outer surface, and they are running parallel to one another, and are fastened at one end to the housing of the container (1)-attached support (3).

What is claimed is:

1. A mixer for bulk material, especially for fibrous suspensions, such as cellulose derivations, comprising a horizontally disposed trough-drum-shaped housing, an axially disposed shaft mounted for rotation within said housing, radially disposed support brackets and mixing blades mounted on said shaft for rotation therewith, at least one milling rim disposed for rotation with said shaft in spaced axial position with respect to said support brackets and mixing blades, said milling rim being mounted in a slanting plane with respect to the longitudinal axis of said shaft to carry out a tumbling motion by rotation, said milling rim being formed of a disk attached to said shaft, a milling stator adjustably mounted in said housing for milling engagement with a peripheral surface of said milling rim, said milling stator having a cylinder-part surface cooperating with a peripheral surface of said disk, and a support for engaging said cylinder-part surface of said milling stator, the support being adjustable from the outside of said housing, said cylinder-part surface being arranged in said housing such that at least one side of each of the mixing blades can be conducted beneath it.

2. A mixer according to claim 1, wherein the peripheral surface of said milling rim and said cylinder-part surface facing said milling rim are profiled.

3. A mixer according to claim 1 or 2, wherein the peripheral surface of said milling rim is formed of interchangeable milling segments.

4. A mixer according to claim 1, further comprising an expansion joint for sealing the support, and wherein said cylinder-part surface adjustable arranged on the support is sealed off by means of said expansion joint.

5. A mixer according to claim 1, wherein said cylinder-part surface is arranged in a lower portion of the housing.

6. A mixer according to claim 5, wherein said cylinder-part surface is arranged in an ascending part of the housing, with respect to the direction of rotation of said shaft.

7. A mixer according to any one of claims 4–6, wherein said cylinder-part surface covers 10–15% of the circumference of said housing.

8. A mixer according to claim 7, wherein said cylinder-part surface covers 25% of the circumference of said housing.

9. A mixer according to claim 1, 2 or 5, further comprising spring means for pressing said cylinder-part surface into engagement with said disk.

10. A mixer according to claim 9, wherein said cylinder-part surface engages said disk with a constant pressure.

11. A mixer according to claim 9, wherein the support engaging said cylinder-part surface is in the form of a spring block.

12. A mixer according to claim 1, wherein the effective width of said disk corresponds approximately to the width dimension of said mixing blades.

* * * * *